US005560147A

United States Patent [19]

Ashida et al.

[11] Patent Number: 5,560,147

[45] Date of Patent: Oct. 1, 1996

[54] MOVABLE LOUVER WINDOW

[75] Inventors: Masaki Ashida; Satoru Manabe, both of Kagawa-ken; Shoji Takahashi, Chiba-ken, all of Japan

[73] Assignee: YKK Architectural Products Inc., Tokyo, Japan

[21] Appl. No.: 418,617

[22] Filed: Apr. 7, 1995

[30] Foreign Application Priority Data

Apr. 25, 1994 [JP] Japan ..... 6-086173
Apr. 25, 1994 [JP] Japan ..... 6-086187
Apr. 25, 1994 [JP] Japan ..... 6-086217

[51] Int. Cl.[6] ..... E06B 7/08

[52] U.S. Cl. ..... 49/74.1; 49/91.1; 49/92.1; 49/403

[58] Field of Search ..... 49/74.1, 91.1, 49/92.1, 403

[56] References Cited

U.S. PATENT DOCUMENTS 2,819,862 1/1958 Limbach ..... 49/403 X
2,845,153 7/1958 West ..... 49/403 X
2,952,885 9/1960 Richardson ..... 49/403 X
2,981,987 5/1961 Schwab ..... 49/403 X
4,813,183 3/1989 Jordal ..... 49/74.1

FOREIGN PATENT DOCUMENTS 1-39288 11/1989 Japan .

*Primary Examiner*—Philip C. Kannan
*Attorney, Agent, or Firm*—Finnegan, Henderson, Farabow, Garrett & Dunner, L.L.P.

[57] ABSTRACT

A movable louver window has a frame body and a plurality of double-vane assemblies each having first and second louver vanes and a pair of left and right coupling members. Each pair of left and right coupling members couples said first and second louver vanes. A plurality of double-vane assemblies are mounted within the frame body. Air-tight and water-tight sealing between the frame body and the double-vane assemblies is established by seal members which are provided over the entire circumference of the frame body and continuously connected with each other.

13 Claims, 10 Drawing Sheets

MOVABLE LOUVER WINDOW

BACKGROUND OF THE INVENTION

1. Field of the Invention

The present invention relates generally to a movable louver window, in which a plurality of double-vane assemblies are mounted within a frame body in vertically pivotable fashion.

2. Description of the Related Art

One example of the movable louver window has been disclosed in Japanese Examined Utility Model Publication (Kokoku) No. Hei 1-39288.

In the disclosed construction, a square or rectangular frame body is formed with an upper frame member, a lower frame member and left and right vertical frame members. A pair of louver vanes are coupled by a pair of clips, each having a pivoting arm, in such manner that the louver vanes are parallel to each other having a space therebetween and are positioned on different elevation from each other, so as to form a double-vane assembly. The double-vane assembly is connected through the clips to left and right vertical frame members in vertically pivotable fashion. Thus, a plurality of double-vane assemblies are mounted within the frame body in vertically pivotable fashion. An interior side upper horizontal seal member and an exterior side upper horizontal seal member are fixed to the upper frame member for establishing sealing between the upper frame member and each of interior side and exterior side louver vanes of the uppermost double-vane assembly. An interior side lower horizontal seal member and an exterior side lower horizontal seal member are fixed to the lower frame member for establishing sealing between the lower frame member and each one of interior side and exterior side louver vanes of the lowermost double-vane assembly. Further, interior side vertical seal member and exterior side vertical seal member are fixed to each of the vertical frame member for establishing sealing between each of the vertical frame members and double-vane assemblies.

In the movable louver window constructed as set forth above, when the movable louver window is closed, a plurality of interior side louver vanes form a continuous wall and a plurality of exterior side louver vanes form another continuous wall and an air layer is formed between those continuous walls. Therefore, the movable louver window constructed as set forth above has high heat insulation ability.

In such movable louver window, the interior side and exterior side upper horizontal seal members are directed toward the interior side, while the interior side and the exterior side lower horizontal seal members are directed toward the exterior side. Further, when the movable louver window is closed, each of louver vanes is slightly oblique with respect to the vertical. Therefore, the interior side and exterior side upper horizontal seal members and the interior side and exterior side lower horizontal seal members are different in position in the depth direction of the frame body.

Therefore, the interior side upper horizontal seal member and the interior side lower horizontal seal member cannot be continuously connected through the interior side vertical seal members, and the exterior side upper horizontal seal member and the exterior side lower horizontal seal member cannot be continuously connected through the exterior side vertical seal members. This results in degradation of watertightness between the frame body and the double-vane assemblies, and rain water may penetrate into the interior side across the double-vane assemblies.

There is also a drawback that once the rain water penetrates into the inside of the frame body, the rain water may accumulate on the lower frame member and may flow toward the interior side in the case of rainstorm and so forth.

Further, in such movable louver window, the frame body on which double-vane assemblies are to be mounted requires to have a depth dimension sufficient to ensure that each of pivoting arms for vertically pivoting double-vane assemblies does not interfere with a fitment such as a net and so forth mounted on the interior side surface of the frame body even when the movable louver window is fully open and an interior side end portion of the pivoting arm projects toward the interior side maximally. In case a pivoting center of each of the double-vane assemblies is placed at a position between a pair of louver vanes, therefore in the exterior side portion of the pivoting arm as in the related art set forth above, a radius of an arc which an interior side end portion of the pivoting arm describes when the movable louver window is opened and closed is relatively large, so that the pivoting arm projects toward the interior side deeply, and therefore the frame body requires to have a large depth dimension. If the pivoting center of the double-vane assembly can be placed substantially at the center of the pivoting arm, a radius of an arc which the interior side end portion of the pivoting arm describes is reduced, so that the pivoting arm projects toward the interior side less deeply, and therefore the depth dimension of the frame body can be reduced. However, in this case, at least a radius of an arc which an upper end portion of an exterior side louver vane describes is enlarged, so that a lower end portion of an interior side louver vane of an upper double-vane assembly may interfere with an upper end portion of an exterior side louver vane of an vertically adjacent lower double-vane assembly so that pivoting movement is hindered.

SUMMARY OF THE INVENTION

Therefore, it is an object of the present invention to provide a movable louver window which can solve the above-mentioned problems.

More specific object of the invention is to provide a movable louver windows in which seal members are continuously connected to each other over the entire circumference of the frame body.

Another object of the present invention is to provide a drain mechanism for draining water such as rain water and so forth accumulating on a lower frame member of a movable louver window.

A further object of the present invention is to provide a mounting structure for mounting double-vane assemblies capable of reducing the required depth dimension of the frame body.

According to the present invention, a movable louver windows comprises:

a quadrilateral frame body having an upper frame member, a lower frame member and left and right vertical frame members;

a plurality of double-vane assemblies each comprising first and second louver vanes and a pair of left and right coupling members each having a pivoting arm, a pair of left and right coupling members coupling first and second louver vanes in such manner that an upper portion of a first louver vane extends upwardly beyond an upper portion of a second louver vane and a lower portion of a second louver vane extends downwardly beyond a lower portion of a first louver vane and that first and second louver vanes are parallel to each other having a space therebetween, a plurality of double-vane assemblies being mounted within the frame body in vertically pivotable fashion and in such manner that when the movable louver window is closed, a lower portion of an upper one of each two vertically adjacent first louver vanes overlaps an upper portion of an lower one of each two vertically adjacent first louver vanes for forming a first continuous wall of louver vanes and a lower portion of an upper one of each two vertically adjacent second louver vanes overlaps an upper portion of a lower one of each two vertically adjacent second louver vanes for forming a second continuous wall of louver vanes and that between the first and second continuous walls of louver vanes is defined a vertically continuous space for forming a heat insulating air layer therein;

sealing means for establishing sealing between the frame body and the double-vane assemblies over the entire circumference of the frame body, the sealing means including an upper horizontal seal member mounted on the upper frame member and directed toward the interior side and provided for being in contact with an uppermost one of the double-vane assemblies, at least one lower horizontal seal member member mounted on the lower frame and directed toward the exterior side and provided for being in contact with an interior side surface of a lower portion of a lowermost one of the double-vane assemblies, vertical seal members mounted on the left and right vertical frame members and directed towards the inside of the frame body and each provided for being in contact with side surfaces of the double-vane assemblies, each of the left and right vertical seal members being connected continuously with the upper horizontal seal member and with the at least one lower horizontal seal member.

In the preferred construction, an uppermost one of the double-vane assemblies further comprises an upper cover engaged on and covering upper portions of first and second louver vanes of the uppermost double-vane assembly and closing an upper end of a space between the first and second louver vanes of the uppermost double-vane assembly. It can be so constructed that the upper horizontal seal member is in contact with an exterior side surface of the upper cover when the movable louver window is closed.

As for the provision of the lower horizontal seal member, a single horizontal seal member may be provided for being in contact with an interior side surface of a lower portion of either one of first and second louver vanes of the lowermost double-vane assembly. Alternatively, each one lower horizontal seal member may be provided for being in contact with an interior side surface of a lower portion of each of the first and second louver vanes of the lowermost double-vane assembly.

The vertical seal member may consists of an upper wider vertical seal member forming an upper portion of the vertical seal member and provided for being in contact with a side surface of at least an upper portion of an uppermost one of the double-vane assemblies and having such width as overlapping side surfaces of both of first and second louver vanes, and first and second narrower vertical seal members forming a subsequent lower portion of the vertical seal member and provided for being in contact with side surfaces of the double-vane assemblies subsequent to the side surface in contact with the upper wider vertical seal member and each having such width as continuously overlapping a side surface of each of the first and second continuous walls of louver vanes, lower end portions of the first and/or second narrower vertical seal members being continuously connected with the at least one lower horizontal seal member. When each one lower horizontal seal member is provided for being in contact with an interior side surface of a lower portion of each of the first and second louver vanes of the lowermost double-vane assembly, respective lower end portions of the first and second narrower vertical seal members are continuously connected with one of the lower horizontal seal members, respectively.

The vertical seal member may also consist of a wide vertical seal member having such width as continuously overlapping side surfaces of both of the first and second continuous walls of louver vanes.

In order to comprise a drain mechanism, the movable louver window may be so constructed that the vertical frame comprises a vertical frame member main body formed integrally with a plurality of vertical plates directed towards the inside of the frame body and a mounting vertical plate mounted on the vertical plates, and the vertical seal member is mounted on the mounting vertical plate and comprises first and second narrow vertical seal members having a vertical space between each other and each provided for continuously overlapping a side surface of each of the first and second continuous walls of louver vanes, at least one of the first and second narrow vertical seal members being continuously connected with the at least one lower horizontal seal member, and the lower frame member laterally extends beyond a lower end of the mounting vertical plate to be connected with the vertical frame main body so as to drain water along a surface of the lower frame member. According to the provision of the lower horizontal seal member as set forth above, either one of the first and second narrow horizontal seal members may be continuously connected with a single lower horizontal seal member, or each of the first and second narrow horizontal seal members may be continuously connected with one of the lower horizontal members.

According to a preferred mounting structure, a movable louver window comprises:

a quadrilateral frame body having an upper frame member, a lower frame member and left and right vertical frame members;

a plurality of double-vane assemblies each comprising first and second louver vanes and a pair of left and right coupling members each having a pivoting arm, a pair of left and right coupling members coupling first and second louver vanes in such manner that an upper portion of a first louver vane extends upwardly beyond an upper portion of a second louver vane and a lower portion of a second louver vane extends downwardly beyond a lower portion of a first louver vane and that first and second louver vanes are parallel to each other having a space therebetween, a plurality of double-vane assemblies being mounted within the frame body in vertically pivotable fashion and in such manner that when the movable louver window is closed, a lower portion of an upper one of each two vertically adjacent first louver vanes overlaps an upper portion of an lower one of each two vertically adjacent first louver vanes for forming a first continuous wall of louver vanes and a lower portion of an upper one of each two vertically adjacent second louver vanes overlaps an upper portion of a lower one of each two vertically adjacent second louver vanes for forming a second continuous wall of louver vanes and that between the first and second continuous walls of louver vanes is defined a vertically continuous space for forming a heat insulating air layer therein;

wherein a pivoting center of each of the double-vane assemblies is positioned on the interior side relative to a first louver vane, and positional relationship between vertically adjacent double-vane assemblies is determined to satisfy:

$$l_3<l_2+l_1 \text{ and } \theta_2>\theta_1$$

wherein $l_1$ is a distance from a pivoting center of an upper double-vane assembly to a lowermost end edge on the interior side of a first louver vane of the upper double-vane assembly;

$l_2$ is a distance from a pivoting center of a vertically adjacent lower double-vane assembly to an uppermost end edge on the exterior side of the second louver vane of the lower double-vane assembly;

$l_3$ is a distance between the pivoting centers of the vertically adjacent upper and lower double-vane assemblies;

$\theta_1$ is an angle defined by a line extending through an intersecting point of a circle $c_1$ centered at the pivoting center of the upper double-vane assembly and having a radius of $l_1$ and a circle $c_2$ centered at the pivoting center of the lower double-vane assembly and having a radius of $l_2$ and the pivoting center of the upper double-vane assembly and a line extending through the lowermost end edge on the interior side of the first louver vane of the upper double-vane assembly and the pivoting center of the upper double-vane assembly; and $\theta_2$ is an angle defined by a line extending through the intersecting point of the circles $c_1$ and $c_2$ and the pivoting center of the lower double-vane assembly and a line extending through the uppermost end edge on the exterior side of the second louver vane of the lower double-vane assembly and the pivoting center of the lower double-vane assembly.

BRIEF DESCRIPTION OF THE DRAWINGS

The present invention will be understood more fully from the detailed description given hereunder and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be described hereinafter in detail with reference to the accompanying drawings. In the following description, numerous specific details are set forth in order to provide a thorough understanding of the present invention. It will be obvious, however, to those skilled in the art that the present invention may be practiced without these specific details. Well-known structures are not shown in detail in order not to unnecessarily obscure the present invention.

Figure 1:
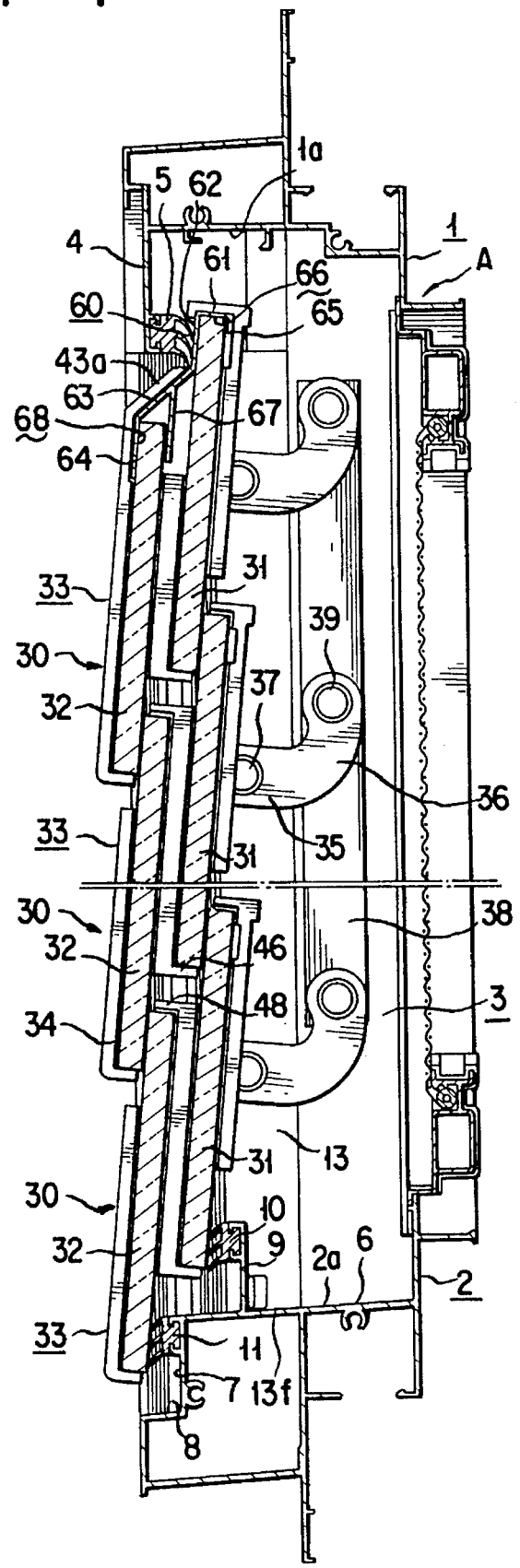
FIG. 1 is a longitudinal section showing one embodiment of a movable louver window according to the present invention.
Figure 2:
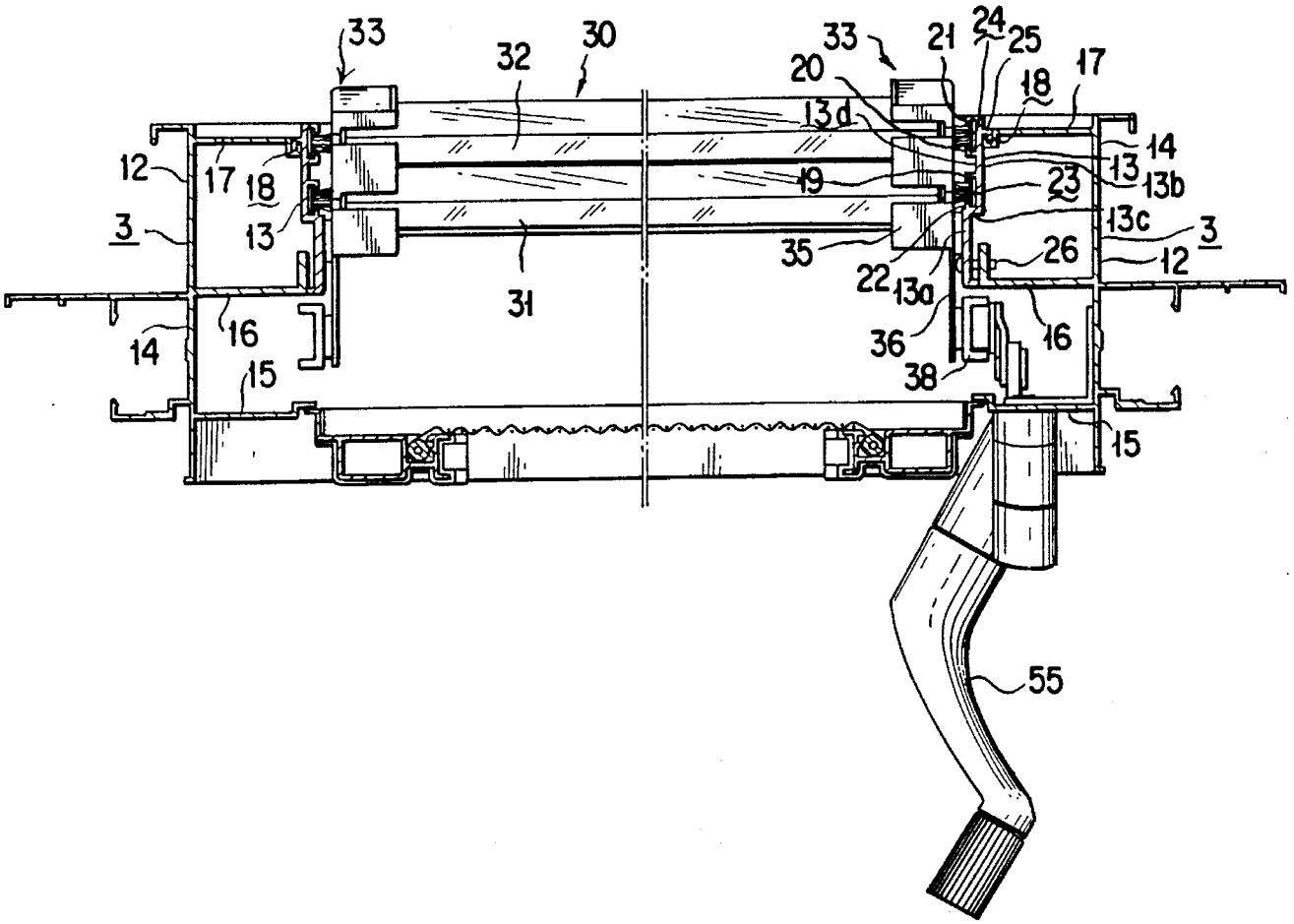
FIG. 2 is a transverse section of the movable louver window of FIG. 1.

As shown in FIGS. 1 and 2, a frame body A is formed in a square or rectangular configuration with an upper frame member 1, a lower frame member 2 and left and right vertical frame members 3, 3. The upper frame member 1 has an exterior side vertical plate 4 projecting downwardly from the inner surface 1*a* of the upper frame member 1. On the exterior side vertical plate 4, an upper horizontal seal member 5 is mounted in an orientation directed to the interior side.

The inner surface 2*a* of the lower frame member 2 is formed into step-like configuration higher on the interior side and lower on the exterior side with an interior side upper lateral plane portion 6, an exterior side vertical plane portion 7 and an exterior side bottom plane portion 8. On the interior side upper lateral plane portion 6, a vertically extending plate portion 9 is formed integrally and an interior side lower horizontal seal member 10 is mounted on the vertically extending plate portion 9 in an orientation directed toward the exterior side. On the upper portion of the exterior side vertical plane portion 7, an exterior side lower horizontal seal member 11 is mounted in an orientation directed toward the exterior side.

The vertical frame 3 comprises a vertical frame member main body 12 and a mounting vertical plate 13. The vertical frame main body 12 is formed by forming an interior side vertical plate 15, an intermediate vertical plate 16 and an exterior side vertical plate 17 integrally on a vertical plate 14 in an orientation directed to the inside of the frame body A. On the projecting end portion of the exterior side vertical plate 17, an engaging recess 18 opening toward the exterior side is formed.

Figure 3:
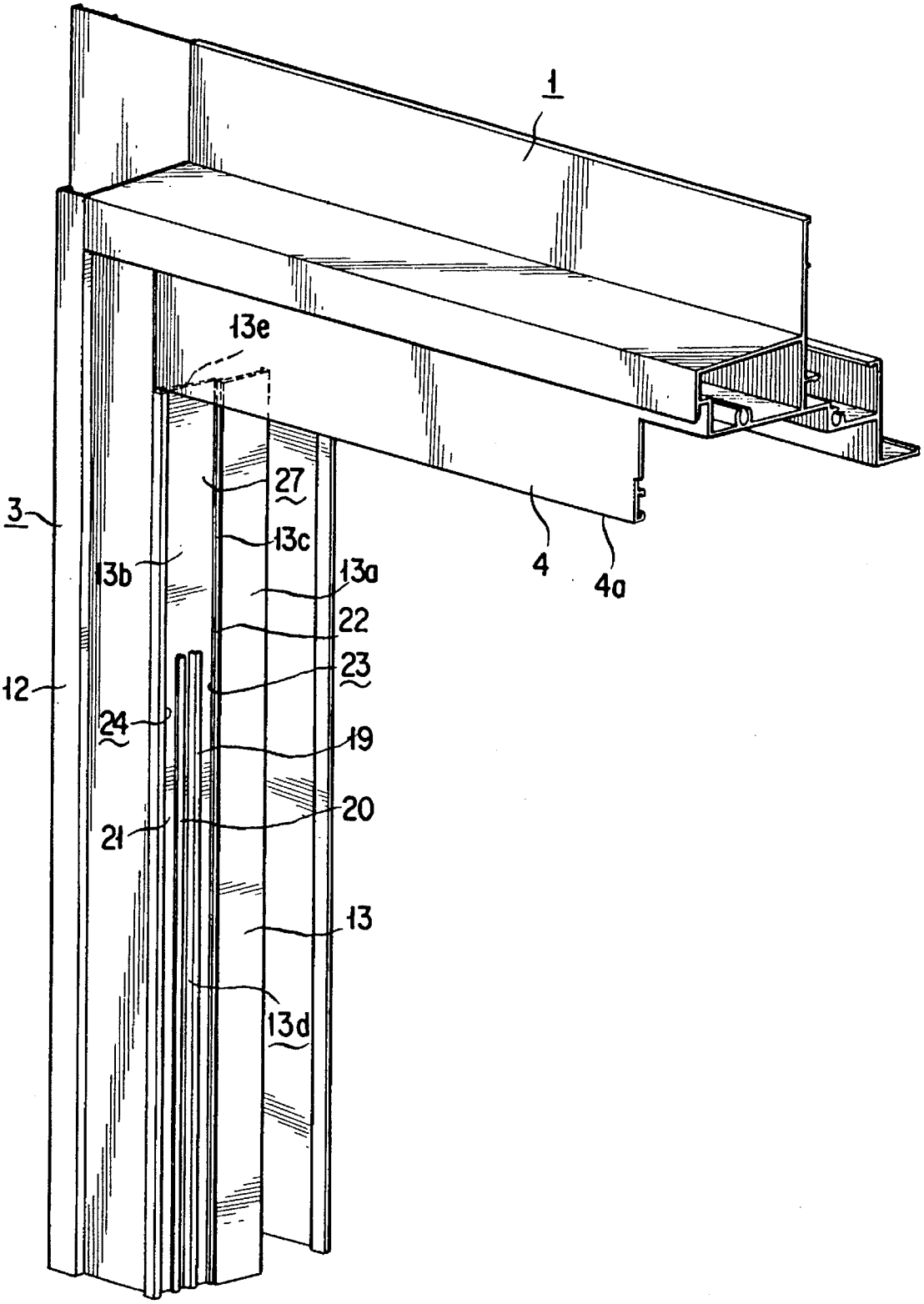
FIG. 3 is a perspective view of a joint between an upper frame member and a vertical frame member.

As also shown in FIG. 3, the mounting vertical plate 13 is formed into a crank-like configuration with an interior side portion 13*a*, an exterior side portion 13*b* and an intermediate portion 13*c*. On the exterior side portion 13*b*, first, second and third hooking pieces 19, 20 and 21 are formed integrally. The first, second and third hooking pieces 19, 20 and 21 are so arranged as having a space between each other in the depth direction of the frame body A and respectively extend in the longitudinal direction of the mounting vertical plate 13. An inwardly directed recess portion 13*d* is formed between the first hooking piece 19 and the second hooking piece 20. A first groove 23 is defined by a projecting piece 22 of the intermediate portion 13*c* and the first hooking piece 19, and a second groove 24 is defined by the second hooking piece 20 and the third hooking piece 21. The mounting vertical plate 13 is coupled with the vertical frame main body 12 by engaging an engaging piece 25 formed integrally with the exterior side portion 13*b* in the engaging recess 18 and by connecting the interior side portion 13*a* to the intermediate vertical plate 16 by screws 26.

The upper end surface 13*e* of the mounting vertical plate 13 is in contact with the lower surface 4*a* of the exterior side vertical plate 4 as shown in FIG. 3, the lower end surface 13*f* of the mounting vertical plate 13 is in contact with the inner surface 2*a* of the lower frame member 2 as shown in FIG. 1, and the longitudinal end face of the vertically extending plate portion 9 is in contact with interior side portion 13*a* of the mounting vertical plate 13.

Figure 4:
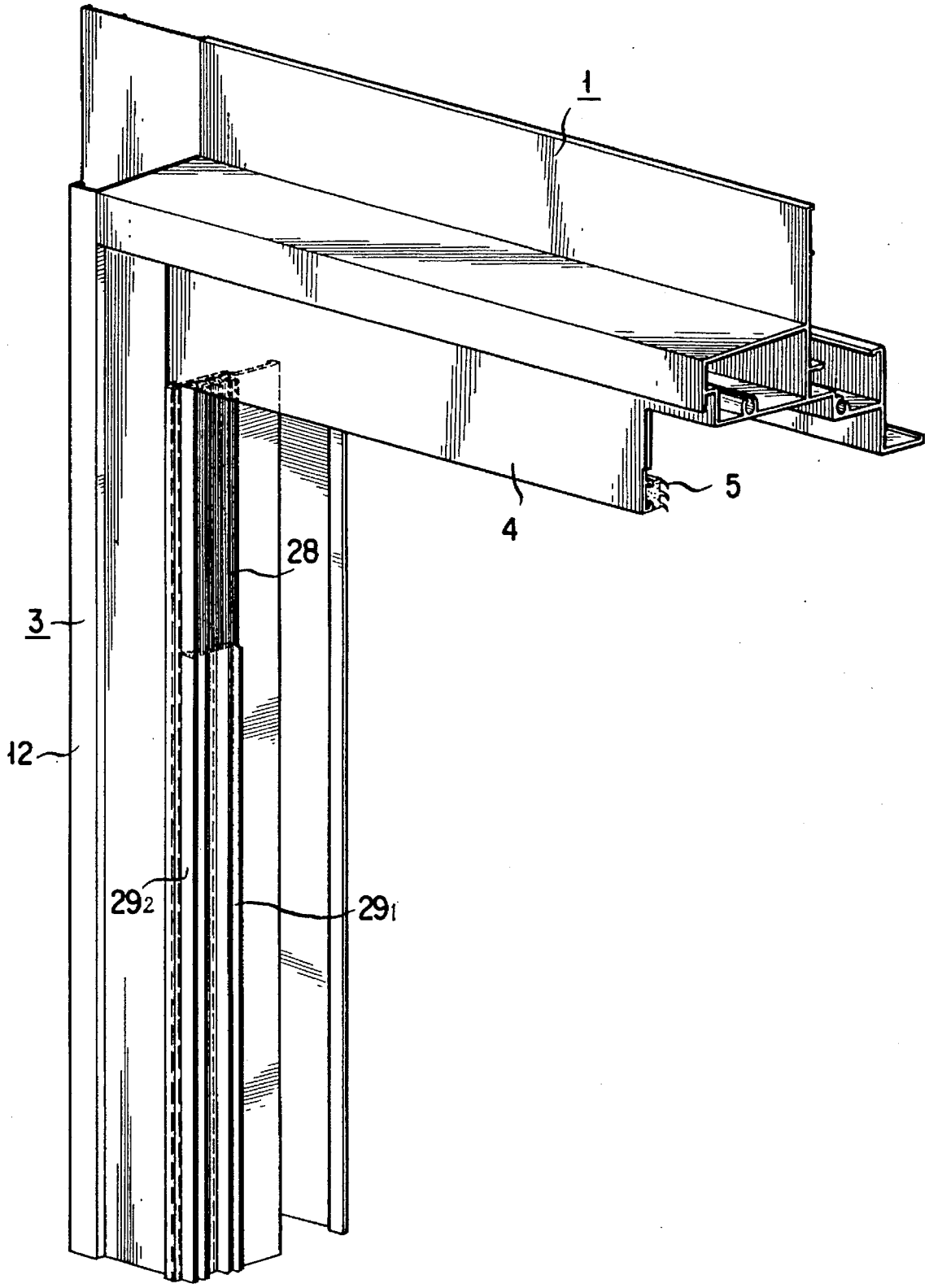
FIG. 4 is a perspective view showing a condition where a vertical seal member is mounted.

As show in FIG. 3, the upper portions of the first and second hooking pieces 19 and 20 of the mounting vertical plate 13 are cut off and an upper wider groove 27 is defined by the third hooking piece 21 and the projecting piece 22. As shown in FIG. 4, an upper wider vertical seal member 28 is mounted within the upper wider groove 27, and first and second narrower vertical seal members $\mathbf{29}_1$ and $\mathbf{29}_2$ are mounted within the first and second grooves 23 and 24. The upper portions of the first and second narrower vertical seal members $\mathbf{29}_1$ and $\mathbf{29}_2$ are continuously connected to the upper wider vertical seal member 28.

As shown in FIGS. 1 and 2, a double-vane assembly 30 comprises a first louver vane 31 and a second louver vane 32 respectively having light permeability such as a glass plate and so forth. The first louver vane 31 and the second louver vane 32 are coupled having a space between each other by left and right coupling members 33. The first louver vane 31 and the second louver vane 32 are positioned parallel to each other and on different elevation. The upper portion of the first louver vane 31 extends upwardly beyond the upper portion of the second louver vane 32, and the lower portion of the second louver vane 32 extends downwardly beyond the lower portion of the first louver vane 31.

Figure 5:
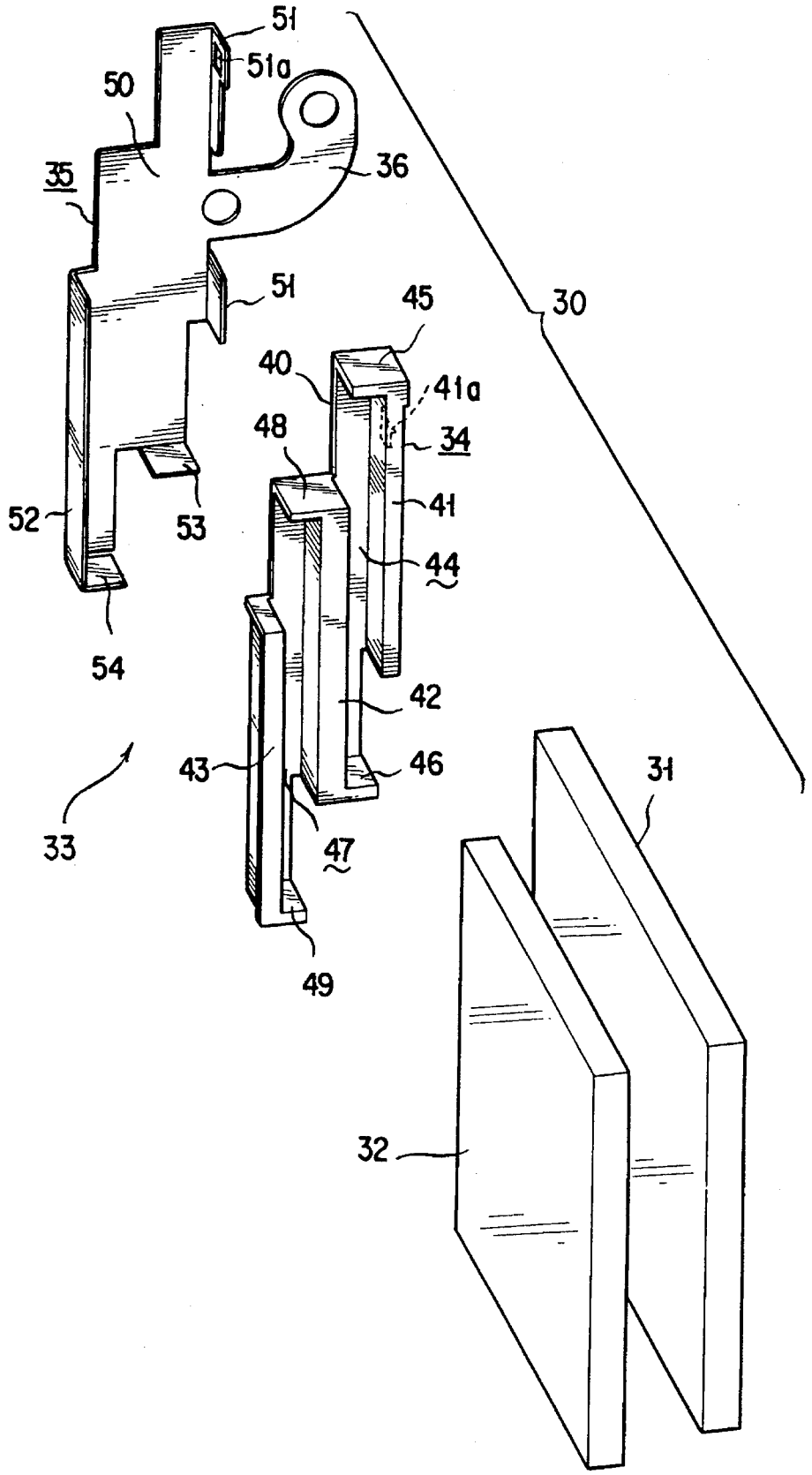
FIG. 5 is a exploded perspective view of a double-vane assembly.

As shown in FIG. 5, each of the left and right coupling members 33 comprises a louver vane holding member 34 and a louver vane mounting member 35. By the louver vane holding member 34, the first and second louver vanes 31 and 32 are coupled having a space between each other. The louver vane mounting member 35 is mounted on and engaged with the louver vane holding member 34. The louver vane mounting member 35 has a pivoting arm 36, and is connected to the interior side portion 13*a* of the mounting vertical plate 13 at the root portion of the pivoting arm 36 by means of a pin 37 in vertically pivotable fashion. The pivoting arm 36 is also connected to a link lever 38 at the interior side end portion by means of a pin 39. The link lever 38 is shifted in the vertical and depth direction of the frame body A by means of a handle 55 (FIG. 2) or so forth so that the louver-vane assemblies 30 connected through the pivoting arms 36 to the link lever 38 are vertically pivoted and the movable louver window is opened and closed.

As shown in FIG. 5, the louver vane holding member 34 includes a vertical plate 40 of narrow and elongated configuration with upper and lower ends shaped into step-like configuration, a sideward holding vertical plate 41 integrally formed at the upper portion of a side edge of the vertical plate 40, an intermediate partitioning vertical member 42 integrally formed at the portion intermediate in the width and vertical direction of the vertical plate 40, and a sideward holding vertical plate 43 formed integrally at the lower portion of the other side edge of the vertical plate 40. Between the sideward holding vertical plate 41 and the intermediate partitioning vertical plate 42, a first groove 44 is defined. The upper portion of the first groove 44 is opened on the side of the intermediate partitioning vertical member 42 and the lower portion of the first groove 44 is opened on the side of the sideward holding vertical plate 41. The upper and lower ends of the first groove 44 are closed by a sideward upper holding piece 45 and an intermediate lower holding piece 46. The first groove 44 is designed for receiving the end of the first louver vane 31.

Between the intermediate partitioning vertical member 42 and the sideward holding vertical plate 43, a second groove 47 is defined. The upper portion of the second groove 47 is opened on the side of the sideward holding vertical plate 43 and the lower portion of the second groove 47 is opened on the side of the intermediate partitioning vertical member 42. The upper and lower ends of the second groove 47 are closed by an intermediate upper holding piece 48 and a sideward lower holding piece 49. The second groove 47 is designed for receiving the end of the second louver vane 32.

As shown in FIG. 5, the louver vane mounting member 35 has a vertical plate 50 of substantially the same configuration as the vertical plate 40 of the louver vane holding member 34. A sideward holding plate 51 is integrally formed at an upper portion of a side edge of the vertical plate 50, and a sideward holding plate 52 is integrally formed at a lower portion of the other side edge of the vertical plate 50. An intermediate lower receiving piece 53 is formed integrally at a portion lower in the vertical direction and intermediate in the width direction of the vertical plate 50, and a sideward lower receiving piece 54 is formed at a position lower and near the side edge of the vertical plate 50. At the upper portion of the other side edge of the vertical plate 50, the pivoting arm 36 is formed integrally.

The louver vane holding member 34 is slid into the louver vane mounting member 35 from the upside and fitted therein. Then, the vertical plate 40 mates with the vertical plate 50, the sideward holding vertical plate 41 mates with the sideward holding vertical plate 51, the sideward holding vertical plate 43 mates with the sideward holding vertical plate 52, the intermediate lower holding piece 46 mates with the intermediate lower receiving piece 53, and the sideward lower holding piece 49 mates with the sideward lower receiving piece 54. The outer surface of the upper portion of the sideward holding vertical plate 41 of the louver vane holding member 34 is provided with an engaging piece 41*a*, and an engaging opening 51*a* is formed at the upper portion of the sideward holding vertical plate 51 of the louver vane mounting member 35. By engagement of the engaging piece 41*a* and the engaging opening 51*a*, disengagement of the louver vane holding member 34 and the louver vane mounting member 35 in the longitudinal direction is prevented.

Among the double-vane assemblies 30, the uppermost double-vane assembly 30 has an upper cover 60 mounted thereon as shown in FIG. 1. The upper cover 60 is formed into a step-like configuration with a sideward horizontal plate 61, an intermediate vertical plate 62, an intermediate oblique plate 63 and a sideward vertical plate 64. A downward directed sideward piece 65 is formed integrally with the sideward horizontal plate 61 to define a first downward directed groove 66 together with the intermediate vertical plate 62. An downward directed intermediate piece 67 is formed integrally with the intermediate oblique plate 63 to define a second downward directed groove 68 together with the sideward vertical plate 64.

The first downward directed groove 66 of the upper cover 60 is engaged with the upper end portion of the first louver vane 31, and the second downward directed groove 68 of the upper cover 60 is engaged with the upper end of the second louver vane 32 to close a space between the first and second louver vanes 31 and 32.

As shown in FIG. 1, a coupling member 33 of the uppermost double-vane assembly is designed to engage with the upper cover 60.

Figure 6:
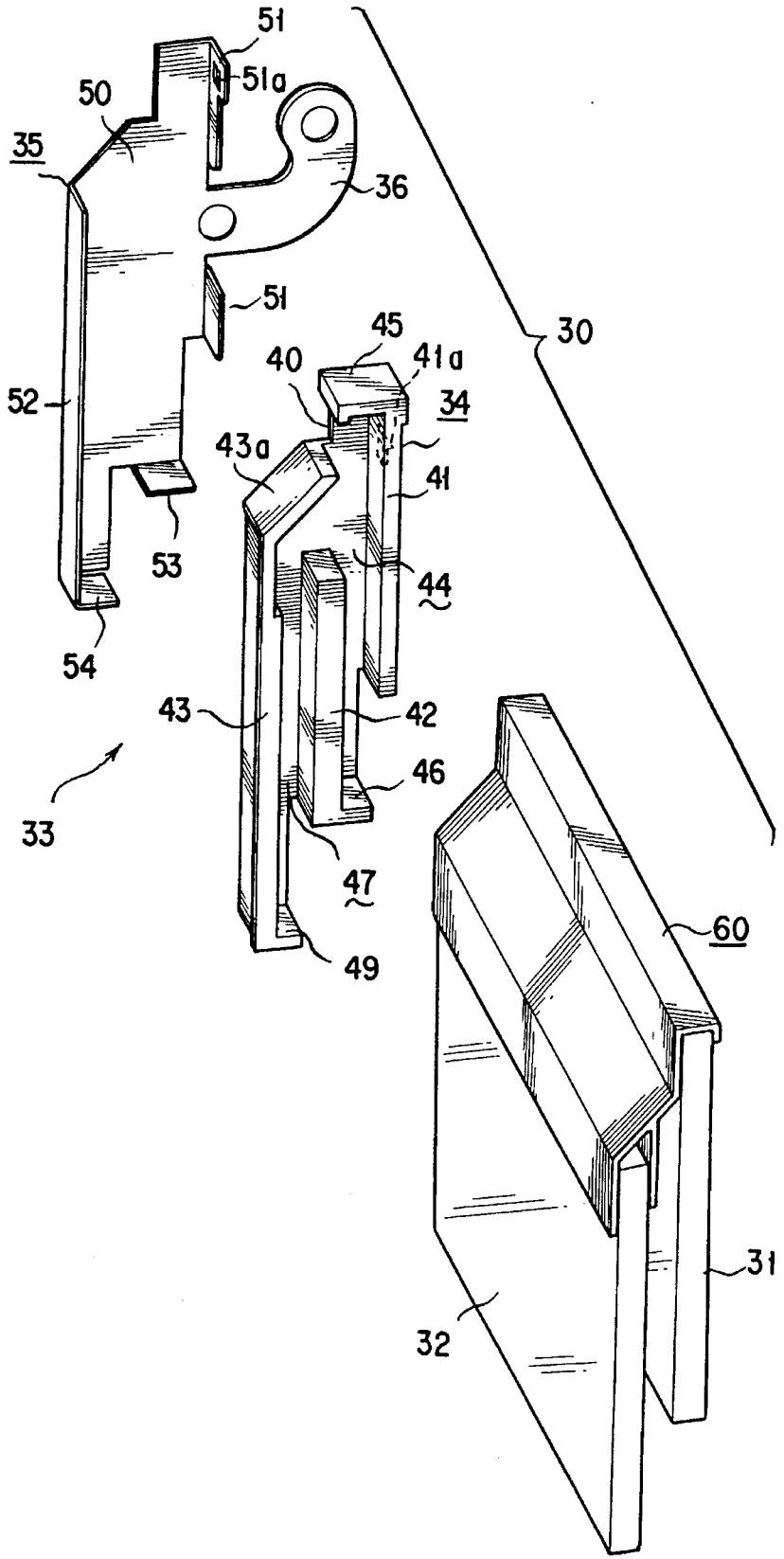
FIG. 6 is an exploded perspective view of an uppermost double-vane assembly.

Namely, as shown in FIG. 6, in the louver vane holding member 34, the sideward holding vertical plate 43 and the side of the vertical plate 40 near the sideward holding vertical plate 43 are extended upwardly, and an oblique holding piece 43*a* is formed continuously from and integrally with the sideward holding vertical plate 43. Thus, the sideward holding vertical plate 43 and the oblique holding piece 43*a* mate with the sideward vertical plate 64 and the intermediate oblique plate 63 of the upper cover 60, respectively, and the vertical plate 40 serves to close an upper end of a space between the first louver vane 31 and the second louver vane 32. The vertical plate 50 and the sideward holding vertical plate 52 of the louver vane mounting member 35 are also extended upwardly.

It is to be noted that the configuration of the coupling member 33 of the uppermost double-vane assembly is not limited to the configuration shown in FIG. 6. The configuration shown in FIG. 5 is also applicable to the uppermost double-vane assembly with a suitable modification of the upper cover 60.

Here, description will be given for the mounting structure for mounting the above-mentioned double-vane assemblies 30 within the frame body A in vertically pivotable fashion.

Figure 1A:
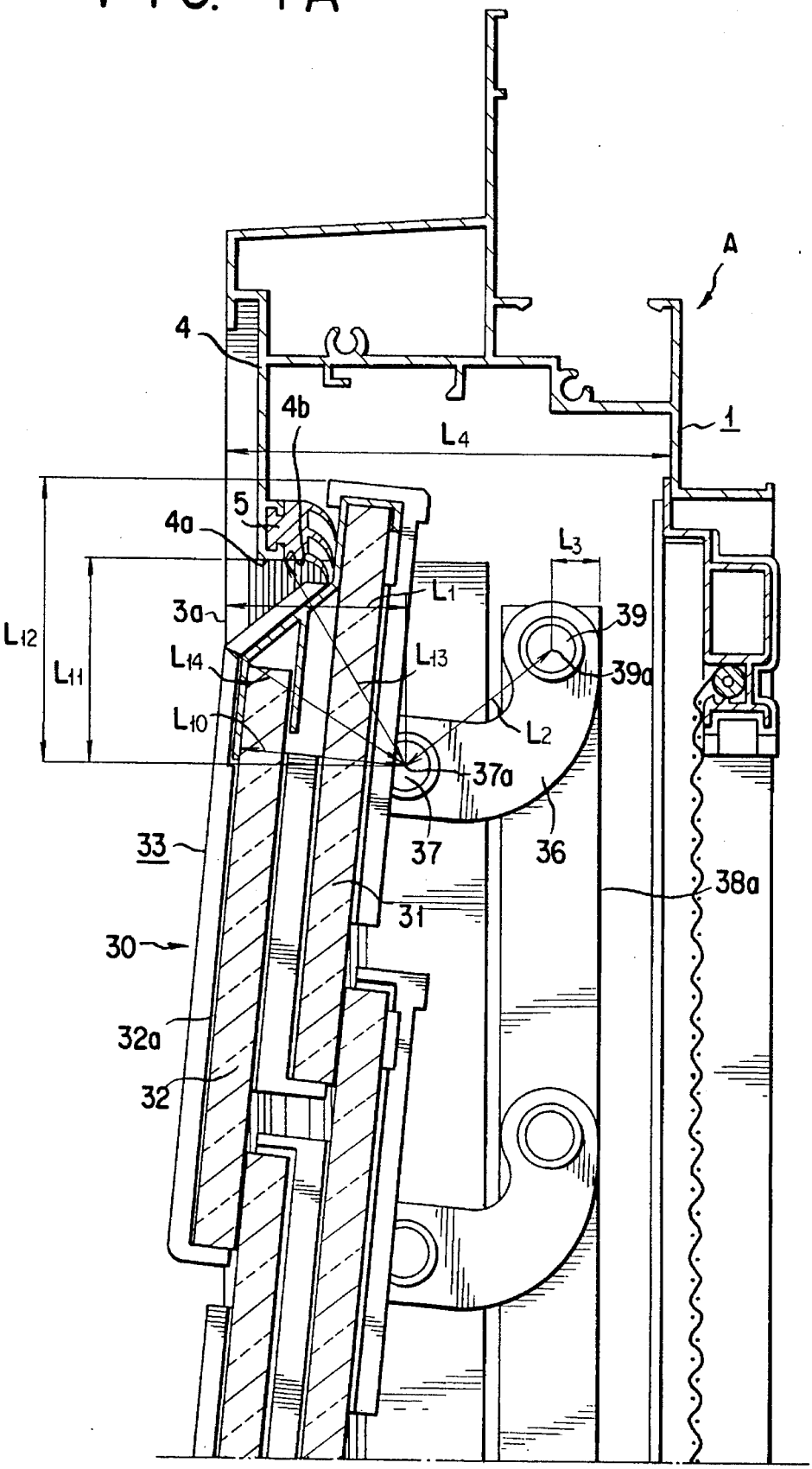
FIG. 1A is an enlarged illustration showing a mounting portion of an uppermost double-vane assembly.

FIG. 1A shows the mounting structure for the uppermost double-vane assembly 30. As shown in FIG. 1A, it is assumed that a distance from a pivoting center 37*a* of the louver vanes (center of the pin 37) to the exterior side end 3*a* of the vertical frame member 3 is $L_1$, a distance from the pivoting center 37*a* of the louver vanes to a pivoting center 39*a* of the pivoting arm 36 (center of the pin 39) is $L_2$, a distance from the pivoting center 39*a* of the pivoting arm 36 to the interior side edge 38a of the link lever 38 is $L_3$, a depth dimension of the frame body A is approximately $L_4$, a distance from the pivoting center 37*a* of the louver vanes to the outer surface 32*a* of the second louver vane 32 is $L_{10}$, a distance in the vertical direction from the pivoting center 37*a* of the louver vanes to the lower end edge 4*a* of the exterior side vertical plate 4 of the upper frame member 1 is $L_{11}$, a distance in the vertical direction from the pivoting center 37*a* of the louver vanes to the uppermost portion of the first louver vane 31 (the uppermost portion of the uppermost double-vane assembly 30) is $L_{12}$, a distance from the pivoting center 37*a* of the louver vanes to the lower end 4*b* on the interior side of the exterior side vertical plate 4 of the upper frame member 1 is $L_{13}$ and a distance from the pivoting center 37*a* of the louver vanes to the uppermost portion on the exterior side of the second louver vane 32 (the uppermost portion on the exterior side of the uppermost double-vane assembly 30) is $L_{14}$.

In order to ensure that the pivoting arm 36 moves within the depth of the frame body A, the following relationship has to be satisfied:

$$L_4 > L_1 + L_2 + L_3 \quad (1)$$

I order to ensure that the uppermost double-vane assembly 30 pivots in vertical direction without interfering with the upper frame member 1, the following dimensional relationship has to be satisfied.

$$L_{10} < L_{11} < L_{12} \quad (2)$$

$$L_{13} > L_{14} \quad (3)$$

Since the distance $L_3$ is much smaller than $L_4$ and thus can be ignored, the foregoing relationship (1) may be approximated by:

$$L_4 > L_1 + L_2 \quad (4)$$

As set forth in the description of the related art, if a pivoting center of the louver vanes can be placed substantially at the center of an area regarded as substantially serving as a pivoting arm (Here, this corresponds to the area extending from the interior side end of the pivoting arm 36 to the exterior side end of the vertical plate 50, following the extending direction of the pivoting arm 36), a radius of an arc which the interior side end portion of the pivoting arm describes is reduced. Therefore, if distances $L_1$ and $L_2$ are set to be substantially equal to each other in the relationship (4), $$L_1 < L_4/2 \quad (5)$$

$$L_2 < L_4/2 \quad (6)$$

When these relationships (5) and (6) are satisfied, it is ensured that the pivoting arm 36 does not project beyond the frame body A. And, in order satisfy the relationships (5) and (6) to place the pivoting center of the louver vanes substantially at the center of the area regarded as substantially serving as a pivoting arm, the pivoting center 37*a* of the louver vanes is placed on the interior side relative to the interior side louver vane 31.

In mounting the second upper and subsequent double-vane assemblies 30, the pivoting center 37*a* of the louver vanes and the pivoting center 39*a* of the pivoting arm 36 are placed at the same positions in the depth direction as those of the uppermost double-vane assembly 30.

Figure 1B:
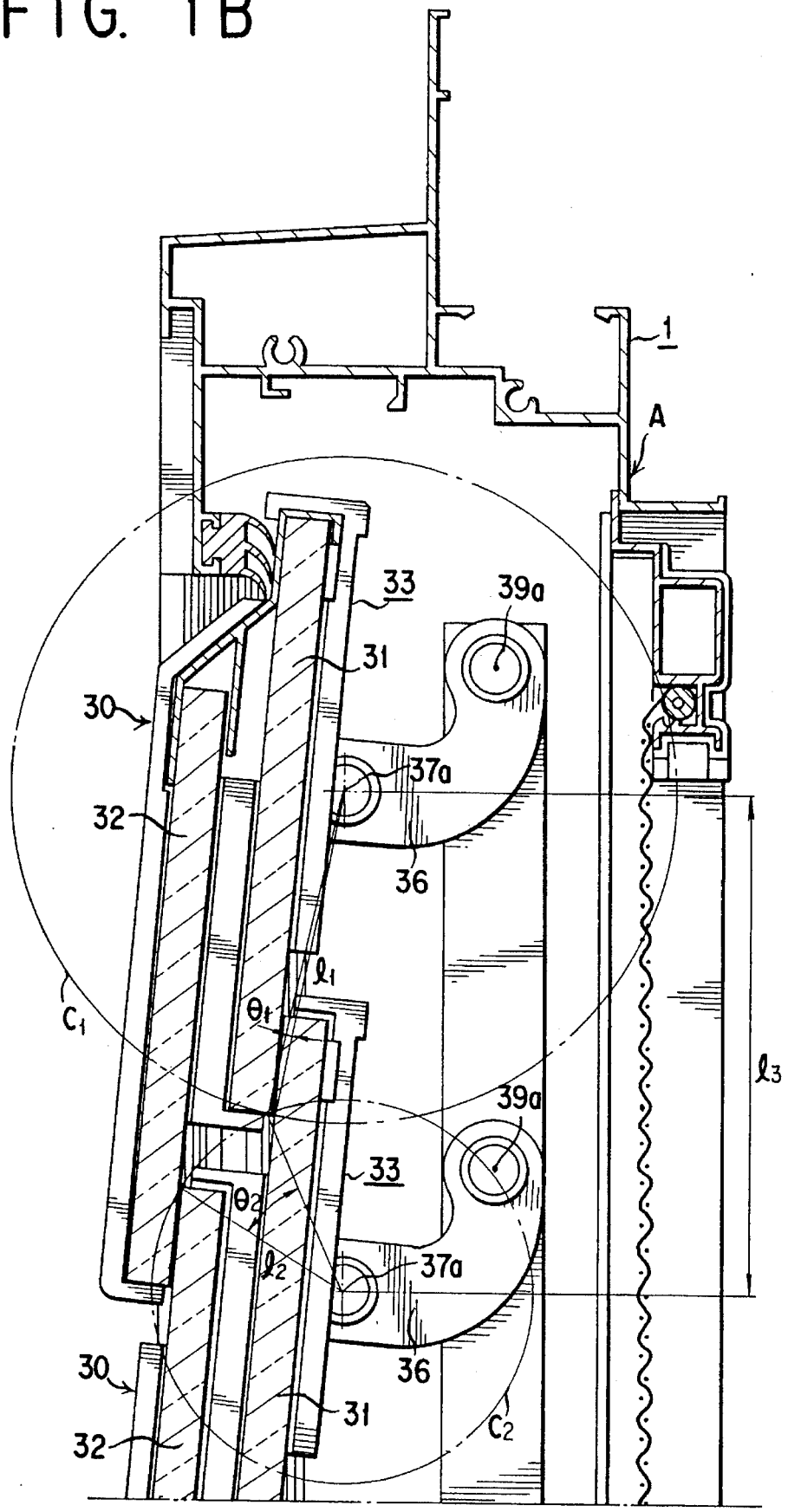
FIG. 1B is an enlarged illustration showing a mounting portions of vertically adjacent double-vane assemblies.

Here, it is assumed that the distance from the pivoting center 37*a* of an upper double-vane assembly to the lowermost end edge on the interior side of the first louver vane 31 of the upper double-vane assembly is $l_1$, a distance from the pivoting center 37*a* of a vertically adjacent lower double-vane assembly to the uppermost end edge on the exterior side of the second louver vane 32 of the lower double-vane assembly is $l_2$, the distance between the pivoting centers 37*a* of the vertically adjacent upper and lower double-vane assemblies is $l_3$, as shown in FIG. 1B.

The pivoting centers 37*a* of the vertically adjacent upper and lower double-vane assemblies are generally so determined that a circle $c_1$ having the radius $l_1$ and a circle $c_2$ having radius $l_2$ intersects with each other. However, when the pivoting centers 37*a* of the double-vane assemblies are placed on the interior side relative to the first louver vanes 31, it is feared that the lower end of the first louver vane 31 of the upper double-vane assembly will interfere with the upper end of the second louver vane 32 of the vertically adjacent lower double-vane assembly so that the pivoting motion in the vertical direction of the double-vane assemblies is hindered.

As a solution for this, an angle $\theta_1$ defined by a line extending through an intersecting point of the circles $c_1$ and $c_2$ and the pivoting center 37*a* of the upper double-vane assembly and a line extending through the lowermost end edge on the interior side of the first louver vane of the upper double-vane assembly and the pivoting center 37*a* of the upper double-vane assembly, and an angle $\theta_2$ defined by a line extending through the intersecting point of the circles $c_1$ and $c_2$ and the pivoting center 37*a* of the vertically adjacent lower double-vane assembly and a line extending through the uppermost end edge on the exterior side of the second louver vane of the lower double-vane assembly and the pivoting center 37*a* of the lower double-vane assembly are determined to satisfy:

$$l_3 < l_1 + l_2 \text{ and } \theta_2 > \theta_1$$

By doing so, even when the pivoting centers 37*a* of the double-vane assemblies are placed on the interior side relative to the first louver vanes 31, the lower end of the first louver vane 31 of the upper double-vane assembly does not interfere with the upper end of the second louver vane 32 of the vertically adjacent lower double-vane assembly so that the pivoting motion of the double-vane assemblies is not hindered.

Returning to FIG. 1, with the shown construction, when a plurality of double-vane assemblies 30 are mounted within the frame body A and the movable louver window is closed as shown in FIG. 1, a lower portion of an upper one of each two vertically adjacent first louver vanes 31 overlaps an upper portion of an lower one of each two vertically adjacent first louver vanes 31 for forming a first continuous wall of louver vanes, and a lower portion of an upper one of each two vertically adjacent second louver vanes 32 overlaps an upper portion of a lower one of each two vertically adjacent second louver vanes 32 for forming a second continuous wall of louver vanes, and between the first and second continuous walls of louver vanes is defined a vertically continuous space for forming a heat insulating air layer therein.

The upper horizontal seal member 5 is in contact with the intermediate vertical plate 62 of the upper cover 60 of the uppermost double-vane assembly 30 and the upper wider vertical seal member 28 is in contact with the upper portion of the vertical plate 50 of the louver vane mounting member 35 in the entire width. Therefore, air-tight and water-tight sealing can be certainly established between the upper portion of the uppermost double-vane assembly 30 and the upper portion of the frame body A.

The interior side surface of the lower portion of the first louver vane 31 of the lowermost double-vane assembly 30 is in contact with the interior side lower horizontal seal member 10, and the interior side surface of the lower portion of the second louver vane 32 of the lowermost double-vane assembly 30 is in contact with the exterior side lower horizontal seal member 11. Thus, air-tight and water-tight sealing can be certainly established between the lowermost double-vane assembly 30 and the lower frame member 2.

The first and second narrower vertical seal members $\mathbf{29}_1$ and $\mathbf{29}_2$ are in contact with the vertical plates 50 of the louver vane mounting members 35 (side surfaces of the double-vane assemblies 30). Each of the first and second narrower vertical seal members $\mathbf{29}_1$ and $\mathbf{29}_2$ has such width as continuously overlapping a side surface of the first and second continuous walls of louver vanes respectively. Therefore, air-tight and water-tight sealing can be certainly established between the double-vane assemblies 30 and the vertical frame member 3. Further, since the first and second narrower seal members $\mathbf{29}_1$ and $\mathbf{29}_2$ are continuously connected with the interior side lower horizontal seal member 10 and the exterior side lower horizontal seal member 11 respectively, continuous air-tight and water-tight sealing can be certainly established over the entire circumference of the frame body A. Thus, the movable louver window having excellent air-tight and water-tight sealing as well as excellent heat insulation can be obtained.

Since a vertically extending space is formed by the inwardly directed recess portion 13*d* between the first and second narrower vertical seal members $\mathbf{29}_1$ and $\mathbf{29}_2$ and between the inner surface of the mounting vertical plate 13 and the side surfaces of the double-vane assemblies 30, rain water penetrating through the overlapping portion of the vertically adjacent second louver vanes 32 flows through an intermediate clearance between the vertically adjacent coupling members 33, that is, through a clearance between the intermediate lower holding piece 46 and the intermediate upper holding piece 48 of the vertically adjacent louver vane holding members 34 into the vertically extending space formed by the inwardly directed recess portion 13*d*, and then flows down through this vertically extending space onto the lower frame member 2. Therefore, the rain water penetrating through the overlapping portion of vertically adjacent second louver vanes 32 will never penetrate through the overlapping portion of the first louver vanes 31 into the interior side.

In the foregoing embodiment, the interior side and exterior side lower horizontal seal members 10 and 11 are provided for being in contact with an interior side surface of a lower portion of the first and second louver vanes 31 and 32 of the lowermost double-vane assembly 30, respectively. However, either one of the interior side and exterior side lower horizontal seal members 10 and 11 can be omitted. That is, only the interior side lower horizontal seal member 10 may be provided for being in contact with an interior side surface of a lower portion of the first louver vane 31 of the lowermost double-vane assembly 30 and be continuously connected with the first narrower vertical seal member $\mathbf{29}_1$, or otherwise, only the exterior side lower horizontal seal member 11 may be provided for being in contact with an interior side surface of a lower portion of the second louver vane 32 of the lowermost double-vane assembly 30 and be continuously connected with the second narrower vertical seal member $\mathbf{29}_2$. Even in this case, improved air- and water-tightness as compared with the prior related art can be obtained.

The vertical seal member, which consists of the upper wider vertical seal member 28 and the first and second narrower vertical seal members $\mathbf{29}_1$ and $\mathbf{29}_2$ in the foregoing embodiment, may be formed by continuously extending the wider vertical seal member in the vertical direction.

Figure 7:
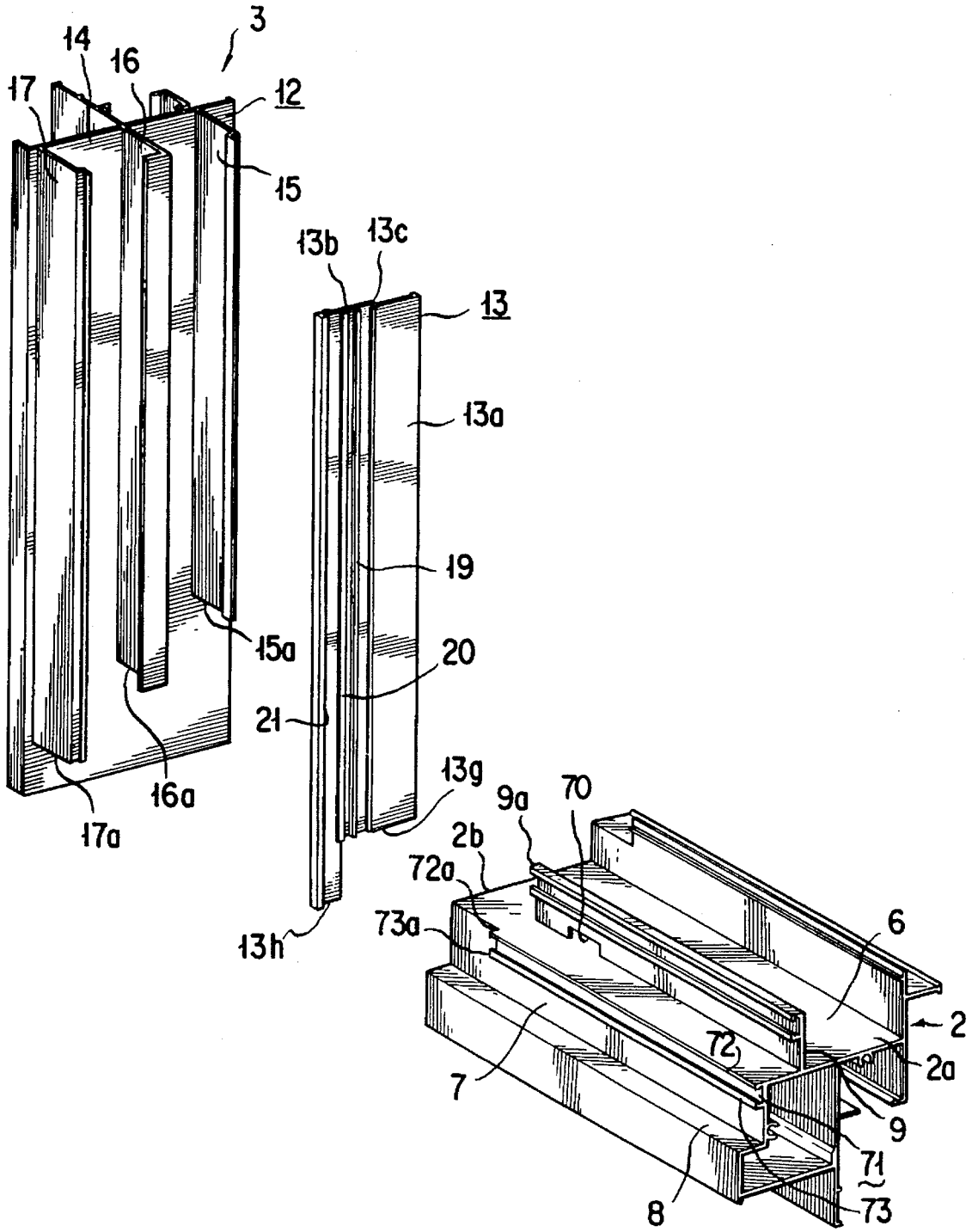
FIG. 7 is an exploded perspective view of a lower frame member and the vertical frame member.

Next, with reference to FIGS. 7 and 8, a drain mechanism which can be incorporated into the shown embodiment of the movable louver window will be described. As seen in FIG. 7, lower end portions of the interior side vertical plate 15, the intermediate vertical plate 16 and the exterior side vertical plate 17 of the vertical frame member 3 are respectively cut off. The lower end portion of the mounting vertical plate 13 is cut off according to the configuration of the inner surface 2*a* of the lower frame member 2. Both of longitudinal end portions of the vertically extending plate portion 9 of the lower frame member 2 are also cut off, and a drain opening 70 communicating with the inner surface 2*a* is formed in the vertically extending plate portion 9. Both of longitudinal end portions of the upper and lower hooking pieces 72 and 73 which form a seal member mounting groove 71 on the exterior side vertical plane portion 7 of the lower frame member 2 are also cut off.

Figure 8:
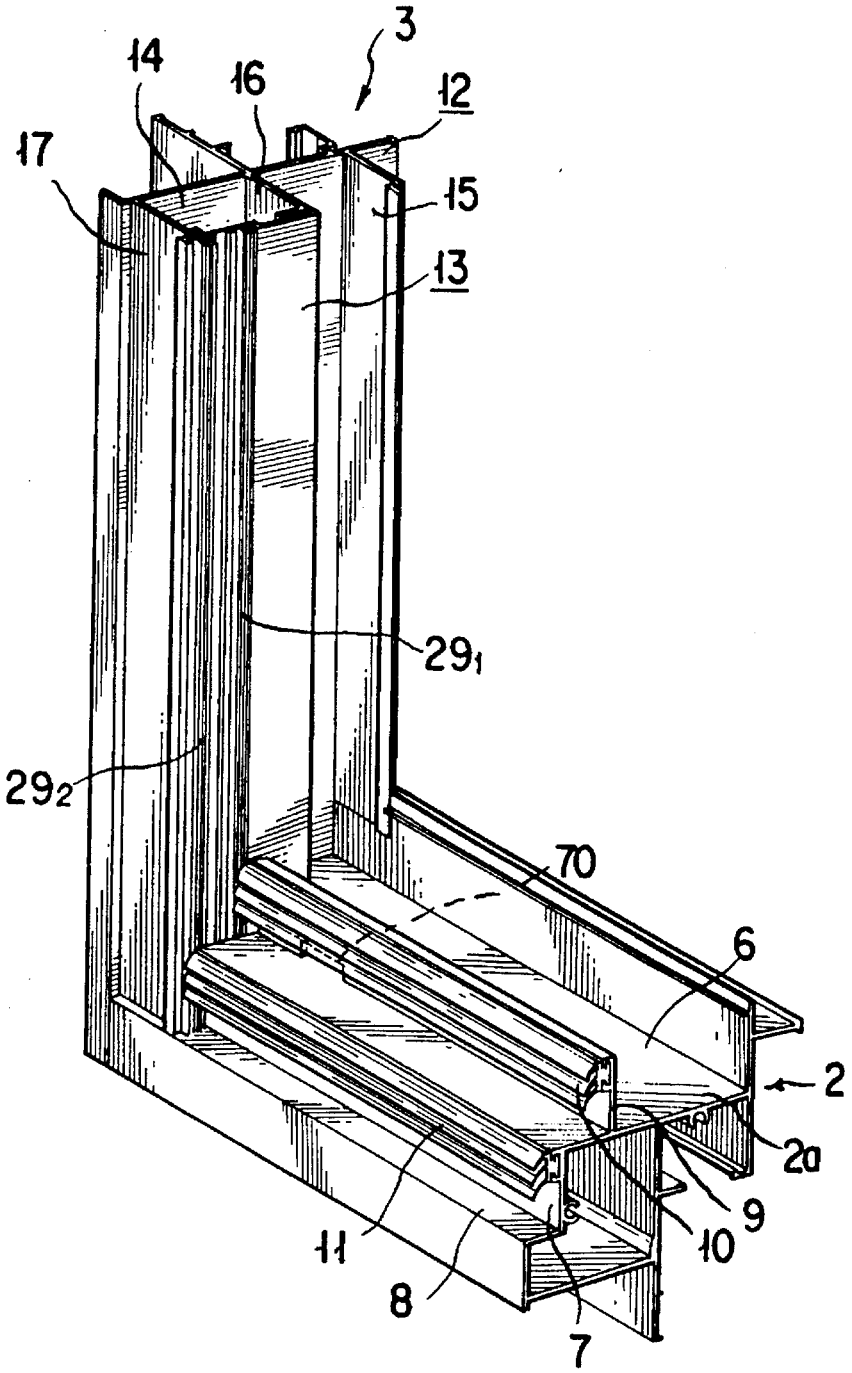
FIG. 8 is a perspective view of a joint between the lower frame member and the vertical frame member.

As shown in FIG. 8, the mounting vertical plate 13 is connected to the vertical frame main body 12 in such a manner that the interior side lower end edge 13*g* thereof is positioned at the equal elevation to the lower end edge 16*a* of the intermediate vertical plate 16 and the exterior side lower end edge 13*h* is positioned at the equal elevation to the lower end edge 17*a* of the exterior side vertical plate 17.

As shown in FIG. 8, the lower frame member 2 and the vertical frame member 3 are connected with screws by mating the longitudinal end face 2*b* of the lower frame member 2 with the vertical plate 14 of the vertical frame main body 12, mating the longitudinal end edge 9*a* of the vertically extending plate portion 9 with the interior side portion 13*a* of the mounting vertical plate 13, mating the longitudinal end edges 72*a* and 73*a* of the upper and lower hooking pieces 72 and 73 with the second hooking piece 20 of the mounting vertical plate 13. The interior side upper plane portion 6 of the lower frame member 2 mates with the lower end edge 16*a* of the intermediate vertical plate 16 and the interior side lower end edge 13*g* of the mounting vertical plate 13, the exterior side bottom plane portion 8 mates with the lower end edge 17*a* of the exterior side vertical plate 17 and the exterior side lower end edge 13*h* of the mounting vertical plate 13, the interior side lower horizontal seal member 10 mates with the first narrower vertical seal member $\mathbf{29}_1$ and the exterior side lower horizontal seal member 11 mate with the second narrower vertical seal member $\mathbf{29}_2$.

With the construction set forth above, the inner surface 2*a* of the lower frame member 2 extends beyond the first and second narrower vertical seal members $\mathbf{29}_1$ and $\mathbf{29}_2$ continuously to the inner surface of the vertical plate 14 of the vertical frame main body 12. Therefore, water on the inner surface 2*a* of the lower frame member 2 flows through the contact portion between the interior side lower end edge 13*g* of the mounting vertical plate 13 and the inner surface 2*a* to the vertical plate 14 of the vertical frame main body 12, and then flows down along the exterior side vertical plane portion 7 to be drained through the contact portion between the exterior side bottom plane portion 8 and the lower end edge 17*a* of the exterior side vertical plate 17.

Accordingly, rain water penetrating through the overlapping portion of vertically adjacent second louver vanes 32 accumulates on the exterior side area of the interior side upper plane portion 6 of the inner surface 2*a* of the lower frame member 2 because the water-tight sealing is established between the second louver vane 32 of the lowermost double-vane louver assembly 30 and the exterior side lower horizontal seal member 11, and then flows through between the first and second narrower vertical seal members $\mathbf{29}_1$ and $\mathbf{29}_2$ to the vertical plate 14 of the vertical frame main body 12, falls along the exterior side vertical plane portion 7, and is drained from the exterior side bottom plane portion 8.

Rain water penetrating though the overlapping portion of the vertically adjacent first louver vanes 31 accumulates on the interior side area behind the vertically extending plate portion 9 of the interior side upper plane portion 6 of the lower frame member 2, and then flows through the drain opening 70, and is drained in the same manner as set forth above.

Thus, when the drain mechanism as set forth above is incorporated into the movable louver window, since the rain water penetrating through the overlapping portion of the vertically adjacent louver vanes and accumulating on the inner surface 2*a* of the lower frame member 2 can be effectively drained through the drain mechanism, the rain water does not penetrate into the interior space beyond the frame body A even at a rainstorm.

It is to be noted that even when either one of the interior side and exterior side lower horizontal seal members 10 and 11 is omitted, substantially the same effect can be expected.

As set forth above, the present invention achieves all of the objects set forth above.

Although the invention has been illustrated and described with respect to the exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set forth above.

What is claimed is:

1. A movable louver window comprising:

a quadrilateral frame body having an upper frame member, a lower frame member and left and right vertical frame members;

a plurality of double-vane assemblies each comprising first and second louver vanes and a pair of left and right coupling members each having a pivoting arm, said pair of left and right coupling members coupling to said first and second louver vanes in such manner that an upper portion of said first louver vane extends upwardly beyond an upper portion of said second louver vane and a lower portion of said second louver vane extends downwardly beyond a lower portion of said first louver vane and that said first and second louver vanes are parallel to each other and having a space therebetween, said plurality of double-vane assemblies vertically and pivotably mounted within said frame body and in such manner that when the movable louver window is closed, a lower portion of an upper one of each two vertically adjacent first louver vanes overlaps an upper portion of a lower one of each two vertically adjacent first louver vanes for forming a first continuous wall of louver vanes and a lower portion of an upper one of each two vertically adjacent second louver vanes overlaps an upper portion of a lower one of each two vertically adjacent second louver vanes for forming a second continuous wall of louver vanes, and that between said first and second continuous walls of louver vanes is defined a vertically continuous space for forming a heat insulating air layer therein;

sealing means for sealing between said frame body and said plurality of double-vane assemblies over the entire circumference of said frame body, said sealing means including an upper horizontal seal member mounted on said upper frame member and directed toward the interior side and being in contact with an uppermost one of said plurality of double-vane assemblies, at least one lower horizontal seal member mounted on said lower frame member and directed toward the exterior side and being in contact with an interior side surface of a lower portion of a lowermost one of said plurality of double-vane assemblies, vertical seal members mounted on said left and right vertical frame members and directed towards the inside of said frame body and each being in contact with side surfaces of said plurality of double-vane assemblies, each of said left and right vertical seal members being connected continuously with said upper horizontal seal member and with said at least one lower horizontal seal member.

2. A movable louver window according to claim 1, wherein an uppermost one of said plurality of double-vane assemblies further comprises an upper cover engaged on and covering upper portions of first and second louver vanes of said uppermost double-vane assembly and closing an upper end of a space between said first and second louver vanes of said uppermost double-vane assembly.

3. A movable louver window according to claim 2, wherein said upper horizontal seal member is in contact with an exterior side surface of said upper cover when the movable louver window is closed.

4. A movable louver window according to claim 1, wherein said at least one lower horizontal seal member is a lower horizontal seal member in contact with an interior side surface of a lower portion of a first louver vane of the lowermost double-vane assembly.

5. A movable louver window according to claim 4, wherein each of said vertical frame members comprises a vertical frame main body formed integrally with a plurality of vertical plates directed towards the inside of said frame body and a mounting vertical plate mounted on said plurality of vertical plates, and each of said vertical seal members is mounted on said mounting vertical plate and comprises first and second narrow vertical seal members spaced from each other and providing a continuously overlapping side surface of said first and second continuous walls of louver vanes respectively, and said first narrow vertical seal member is continuously connected with said lower horizontal seal member, and wherein said lower frame member laterally extends beyond a lower end of said mounting vertical plate to be connected with said vertical frame main body so as to drain water along a surface of said lower frame member.

6. A movable louver window according to claim 1, wherein said at least one lower horizontal seal member is a lower horizontal seal member in contact with an interior side surface of a lower portion of a second louver vane of the lowermost double-vane assembly.

7. A movable louver window according to claim 6, wherein each of said vertical frame member comprises a vertical frame main body formed integrally with a plurality of vertical plates directed towards the inside of said frame body and a mounting vertical plate mounted on said plurality of vertical plates, and each of said vertical seal members is mounted on said mounting vertical plate and comprises first and second narrow vertical seal members spaced from each other and providing a continuously overlapping a side surface of said first and second continuous walls of louver vanes respectively, and wherein said second narrow vertical seal member is continuously connected with said lower horizontal seal member, and said lower frame member extends laterally beyond a lower end of said mounting vertical plate to be connected with said vertical frame main body so as to drain water along a surface of said lower frame member.

8. A movable louver window according to claim 1, wherein said at least one lower horizontal seal member is in contact with an interior surface of a lower portion of the respective first and second louver vanes of the lowermost double-vane assembly.

9. A movable louver window according to claim 8, wherein each of said vertical seal member includes an upper wider vertical seal member forming an upper portion of said vertical seal member and being in contact with a side surface of at least an upper portion of an uppermost one of said plurality of double-vane assemblies and having such width as overlapping side surfaces of both of first and second louver vanes, and first and second narrower vertical seal members forming a subsequent lower portion of said vertical seal member and being in contact with side surfaces of said plurality of double-vane assemblies subsequent to said side surface in contact with said upper wider vertical seal member and each continuously overlapping a side surface of each of said first and second continuous walls of louver vanes, and lower end portions of said first and second narrower vertical seal members are continuously connected with said lower horizontal seal members, respectively.

10. A movable louver window according to claim 8, wherein each of said vertical frame members comprises a vertical frame main body formed integrally with a plurality of vertical plates directed towards the inside of said frame body and a mounting vertical plate mounted on said plurality of vertical plates, and each of said vertical seal members is mounted on said mounting vertical plate and comprises first and second narrow vertical seal members spaced from each other and providing a continuously overlapping a side surface of said first and second continuous walls of louver vanes respectively, and wherein said first and second narrow vertical seal members are continuously connected with said lower horizontal seal members respectively, and said lower frame member laterally extends beyond a lower end of said mounting vertical plate to be connected with said vertical frame main body so as to drain water along a surface of said lower frame member.

11. A movable louver window according to claim 1, wherein each of said vertical seal member includes an upper wider vertical seal member forming an upper portion of said vertical seal member and in contact with a side surface of at least an upper portion of an uppermost one of said plurality of double-vane assemblies and having such width as overlapping side surfaces of both of first and second louver vanes, and first and second narrower vertical seal members forming a subsequent lower portion of said vertical seal member and being in contact with side surfaces of said plurality of double-vane assemblies subsequent to said side surface in contact with said upper wider vertical seal member and each having such width as continuously overlapping a side surface of each of said first and second continuous walls of louver vanes, wherein lower end portions of at least one of said first and second narrower vertical seal members are continuously connected with said at least one lower horizontal seal member.

12. A movable louver window according to claim 1, wherein each of said vertical seal member consists of a wide vertical seal member having such width as continuously overlapping side surfaces of both of said first and second continuous walls of louver vanes.

13. A movable louver window comprising:

a quadrilateral frame body having an upper frame member, a lower frame member and left and right vertical frame members;

a plurality of double-vane assemblies each comprising first and second louver vanes and a pair of left and right coupling members each having a pivoting arm, said pair of left and right coupling members coupling said first and second louver vanes such that an upper portion of said first louver vane extends upwardly beyond an upper portion of said second louver vane and a lower portion of said second louver vane extends downwardly beyond a lower portion of said first louver vane and that said first and second louver vanes are parallel to each other having a space therebetween, said plurality of double-vane assemblies being mounted within said frame body in vertically pivotable fashion such that when the movable louver window is closed, a lower portion of an upper one of each two vertically adjacent first louver vanes overlaps an upper portion of a lower one of each two vertically adjacent first louver vanes for forming a first continuous wall of louver vanes and a lower portion of an upper one of each two vertically adjacent second louver vanes overlaps an upper portion of a lower one of each two vertically adjacent second louver vanes for forming a second continuous wall of louver vanes and that between said first and second continuous walls of louver vanes is defined a vertically continuous space for forming a heat insulating air layer therein;

wherein a pivoting center of each of said double-vane assemblies is positioned on the interior side relative to a first louver vane, and positional relationship between vertically adjacent double-vane assemblies is determined to satisfy:

$l_2 < l_2 + l_1$ and $\theta_2 > \theta_1$ wherein $l_1$ is a distance from a pivoting center of an upper double-vane assembly to a lowermost end edge on the interior side of the first louver vane of the upper double-vane assembly;

$l_2$ is a distance from a pivoting center of a vertically adjacent lower double-vane assembly to an uppermost end edge on the exterior side of the second louver vane of the lower double-vane assembly;

$l_3$ is a distance between the pivoting centers of the vertically adjacent upper and lower double-vane assemblies;

$\theta_1$ is an angle defined by a line extending through an intersecting point of a circle $c_1$ centered at the pivoting center of the upper double-vane assembly and having a radius of $l_1$ and a circle $c_2$ centered at the pivoting center of the lower double-vane assembly and having a radius of $l_2$ and the pivoting center of the upper double-vane assembly and a line extending through the lowermost end edge on the interior side of the first louver vane of the upper double-vane assembly; and $\theta_2$ is an angle defined by a line extending through the intersecting point of the circles $c_1$ and $c_2$ and the pivoting center of the lower double-vane assembly and a line extending through the uppermost end edge on the exterior side of the second louver vane of the lower double-vane assembly and the pivoting center of the lower double-vane assembly.

* * * * *

UNITED STATES PATENT AND TRADEMARK OFFICE

CERTIFICATE OF CORRECTION

PATENT NO. : 5,560,147

DATED : October 01, 1996

INVENTOR(S) : Masaki ASHIDA et al.

It is certified that error appears in the above-indentified patent and that said Letters Patent is hereby corrected as shown below:

Claim 7, column 15, line 23, "member" should read --members--.

Claim 7, column 15, line 30, after "overlapping", delete "a".

Claim 9, column 15, line 45, "member" should read --members--.

Claim 10, column 16, line 2, after "overlapping" delete "a".

Claim 12, column 16, line 29, "said vertical seal member" should read --said vertical seal members--.

Signed and Sealed this

Twenty-fifth Day of February, 1997

*Attest:*

BRUCE LEHMAN

*Attesting Officer*

*Commissioner of Patents and Trademarks*